US009027497B1

(12) United States Patent
Tulupov et al.

(10) Patent No.: US 9,027,497 B1
(45) Date of Patent: May 12, 2015

(54) EQUIPMENT AND METHODS FOR OPERATING GEOPHYSICAL BOTTOM STATIONS

(71) Applicants: Andrey Vladimirovich Tulupov, Moscow (RU); Evgeny Dmitrievich Lisitsyn, St. Petersburg (RU); Vladimir Eduardovich Kyasper, St. Petersburg (RU); Alexander Arkadevich Petrov, St. Petersburg (RU)

(72) Inventors: Andrey Vladimirovich Tulupov, Moscow (RU); Evgeny Dmitrievich Lisitsyn, St. Petersburg (RU); Vladimir Eduardovich Kyasper, St. Petersburg (RU); Alexander Arkadevich Petrov, St. Petersburg (RU)

( * ) Notice: Subject to any disclaimer, the term of this patent is extended or adjusted under 35 U.S.C. 154(b) by 0 days.

(21) Appl. No.: 14/186,188

(22) Filed: Feb. 21, 2014

(30) Foreign Application Priority Data

Nov. 20, 2013 (RU) ..... 2013151538

(51) Int. Cl.

| | |
|---|---|
| ***B63B 27/00*** | (2006.01) |
| ***B63B 35/00*** | (2006.01) |
| ***B63B 17/00*** | (2006.01) |
| *F16L 1/12* | (2006.01) |

(52) U.S. Cl.
CPC ..... *B63B 35/00* (2013.01); *B63B 17/00* (2013.01); *B63B 2211/02* (2013.01)

(58) Field of Classification Search
CPC ..... B63B 35/00; B63B 17/00; B63B 2211/02
USPC ..... 114/242, 253, 254, 268, 269; 405/166; 226/1, 76; 254/134.3 SC; 242/470
See application file for complete search history.

(56) References Cited

U.S. PATENT DOCUMENTS

| | | | | |
|---|---|---|---|---|
| 2,924,328 | A * | 2/1960 | Lidderdale | 226/176 |
| 3,216,636 | A * | 11/1965 | Kothe | 226/1 |
| 3,911,690 | A * | 10/1975 | Gracia | 405/166 |
| 4,313,392 | A * | 2/1982 | Guenther et al. | 114/244 |
| 5,197,716 | A * | 3/1993 | Zibilich et al. | 254/134.3 SC |
| 5,199,659 | A * | 4/1993 | Zibilich, Jr. | 242/470 |
| 5,655,753 | A * | 8/1997 | Berges et al. | 254/134.3 SC |
| 7,883,292 | B2 * | 2/2011 | Thompson et al. | 405/166 |
| 8,021,080 | B2 * | 9/2011 | Frivik et al. | 405/166 |
| 8,087,848 | B2 * | 1/2012 | Thompson et al. | 405/166 |

* cited by examiner

*Primary Examiner* — Daniel V Venne
(74) *Attorney, Agent, or Firm* — Aleksandr Smushkovich

(57) ABSTRACT

An equipment complex for deploying and recovering marine geophysical seismic or electric-survey bottom stations is mounted on a ship. The complex includes—a powered capstan, —rotatable turntables and rolls, —load-bearing units connected to the bottom stations by various fasten means and capable of winding onto the capstan and turntables, a work platform supporting a bottom station placed thereon, —an indicator for registration of the bottom stations' coordinates, mounted on the platform, —a limit switch mounted on the platform, switching ON when the bottom station is placed on the work platform, and OFF when it's removed therefrom providing for operation of the indicator. The complex may include floating buoys, damping loads, and halyards for deploying the stations. Methods for deploying and recovering the bottom stations using the equipment complex are described. Some recovering methods contemplate winding the load-bearing units onto the capstan, while switching the turntables for each subsequent load-bearing unit.

11 Claims, 7 Drawing Sheets

EQUIPMENT AND METHODS FOR OPERATING GEOPHYSICAL BOTTOM STATIONS

CROSS-REFERENCE TO RELATED APPLICATION

This U.S. patent application claims priority under the Paris Convention and 35 U.S.C. 119 (a) through (d) from a Russian patent application RU2013151538 filed on 20 Nov. 2013 hereby entirely incorporated by reference.

FIELD OF THE INVENTION

The invention relates to marine survey geophysics, in particular, to the equipment for prognosis of hydrocarbon deposits under the seabed with the help of bottom stations.

BACKGROUND OF THE INVENTION

Nowadays, there are known a variety of methods for research of influence of seismic waves or electromagnetic field impulses upon a seabed, a subsequent registration of changes of near-bottom strata parameters, and analysis of thus obtained data for a detection of existing anomalies and a determination of their nature. These methods are widely employed for survey of seabed hydrocarbons deposits. The surveys are executed with the help of various research equipment complexes (e.g., taught in RU2236028, 2004; SU1122998, 1984; SU1798666, 1996; SU1434385, 1988; U.S. Pat. No. 4,298,840, 1981; U.S. Pat. No. 4,617,518, 1986, RU2324956, 2007). Recently, a trend in marine geophysics has been developed for the use of bottom stations (also known as bottom systems), herein further referred to as 'BS', for gathering information on seabed strata, including both self-emerging BS, and BS without self-emerging capacity.

The type and configuration of BSs used are determined by survey specifics, as well as by the seabed relief, in particular, by the depths in the marine survey zone. At the same time, for obtaining a reliable prognosis, it's necessary to keep a range of conditions, in particular, deployment of the BSs at a certain distance from each other and obtaining accurate information on the locations of BSs on the seabed.

In this connection, the equipment, ensuring the placement of BS on the seabed and their return on the ship's board, becomes particularly important.

For providing a fixed placement of seismic BSs on the seabed, a company named Sea Bird (see D. E. LEVASHOV Modern ships and ship equipment for fishing researches, VNIRO, 2010 p. 197-200) used a specifically equipped underwater remotely operated vehicle (ROV). Such a method ensures high accuracy of the BSs placement; however, it is extremely unproductive and very expensive. Moreover, it requires a ship of significant dimensions and allows for working only with relatively compact seismic stations.

Typically, at the majority of ships used for placement of the BSs, various trawl and auxiliary winches, as well as cargo cranes are employed (D. E. LEVASHOV Modern ships and ship equipment for fishing researches, VNIRO, 2010 p. 197-271). However this equipment is bulky, requires a large space, and doesn't provide for a precise placement of the BSs.

For increasing the efficiency of BS operations, especial cargo-grasping devices were designed (e.g. RU 2034767, 1995; RU 2025427, 1994), comprising a case provided with rotational jaws and a mechanism for operating thereof. However, such devices have the following deficiencies: they are slow-working, in particular, in tossing conditions; and it's difficult to adjust the rotational jaws at clamp places of the cargo.

For deployment of electrical survey BSs, the instant inventors have developed a manipulator device (RU90006, 2009), comprising a frame, jaws hingedly coupled with the frame, a drive for closing the jaws, and a mechanism for suspension of the frame and coupling thereof to the manipulator's boom, also supplied with a damper, allowing for rotation of the frame relative to the boom in the vertical plane of the manipulator's movement and in the plane of rotation of the frame relative to the boom. The manipulator device ensured a deployment of BSs with a complicated design, but it wasn't sufficiently efficient for mass deployments.

There is known a patent application publication US 2011/0051550 A1, teaching an equipment complex, wherein a number of seismic stations, each including two connection links, are placed on the seabed with the help of connecting elements made of a cable, rope, or halyard, and having, at their ends, connecting parts of a spring hook (carabine) type. The distance between seismic receivers on the sea bottom is determined by the length of the connecting element. During deployment of the seismic BSs, they are placed on a frame assembly and are preliminary connected with freely coiled connecting elements. Such complex and deployment system ensure a sufficiently accurate placement (2% of the sea depth) of the BSs on the sea bottom for works at depths not exceeding 50 m. However, it is not satisfactory at greater sea depths, wherein a ratio of the distance between the BSs and the connecting element length decreases nonlinearly. Moreover, in this complex's configuration, at lifting BSs with two fastening points, difficulties arise due to a tension on the connecting elements.

The nearest to the claimed solution is U.S. Pat. No. 7,649,803, teaching an equipment complex mounted on a special ship, which complex ensures a deployment of a number of seismic BSs on the seabed, and their lifting onto the ship's board after the completion of sea works. The complex comprises a line located on a winch; wherein the line includes BS fastening knots of a split ring type, connected with one another by load-bearing units, while the length of the line ensures placement of the seismic BSs along the entire survey profile. The load-bearing units can be made of a non-stretched halyard, rope, or isolated cable, having negative floatation.

The aforementioned complex is highly technologically effective at deploying and lifting BSs, and ensures uniformity of their placement on the seabed. However, it's employable only on specialized ships and is destined only for works with a certain type of seismic stations.

BRIEF SUMMARY OF THE INVENTION

The present invention proposes an equipment complex capable of operating on regular (non-specialized) ships, including ones of a small size, with different kinds of BSs, including self-emerging ones, as well as placement of different types of BSs within one survey profile on the seabed.

The invention contemplates an equipment complex for deploying (i.e. submerging from the ship's board and securing/installation on the seabed) and recovering (i.e. extracting and lifting onto the ship's board) of marine geophysical bottom stations of different types, including electric-survey BSs or seismic BSs; wherein the equipment complex comprises: at least two turntables for placement of sectioned load-bearing units; at least one power device of a "capstan" type; a number of technological devices for deploying the bottom stations, each including at least one roll; at least one work platform for placement of the bottom stations with a navigation system indicator equipped with a photo-camera; a magnetic mark reader; and a limit switch.

BRIEF DESCRIPTION OF DRAWINGS OF THE INVENTION

Preferred embodiments of the inventive equipment complex are illustrated in drawings attached hereto, wherein.

Figure 3A:
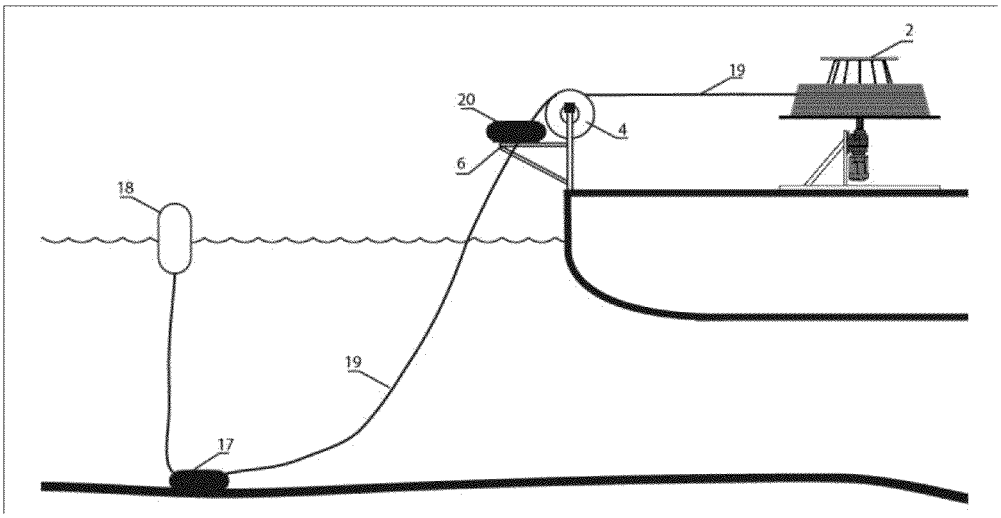
Figure 3B:
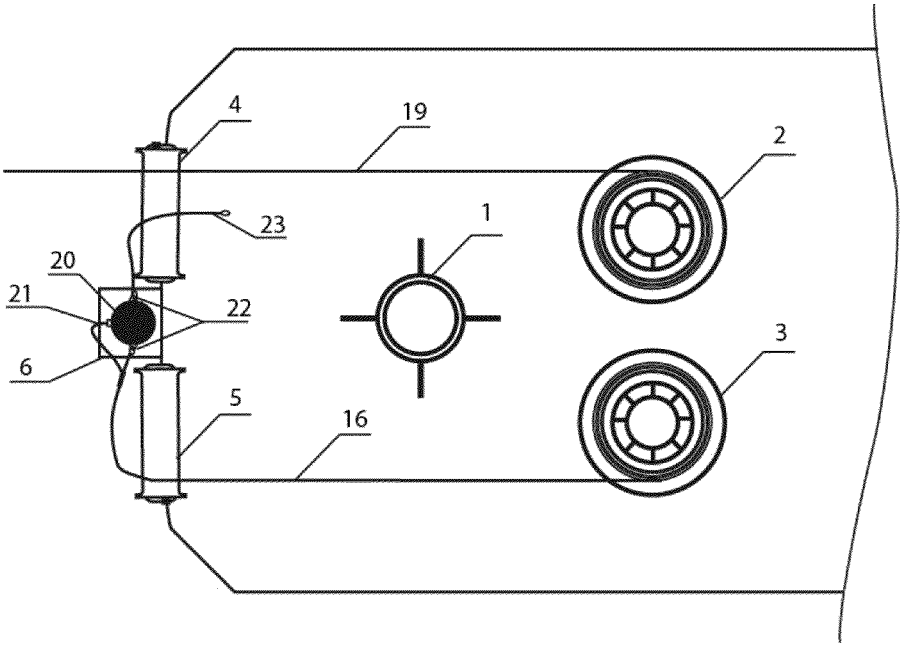

FIGS. 3A and 3B schematically depict a method of deployment of electric-survey BSs and equipment for implementation thereof, according to a preferred embodiment of the present invention.

Figure 4A:
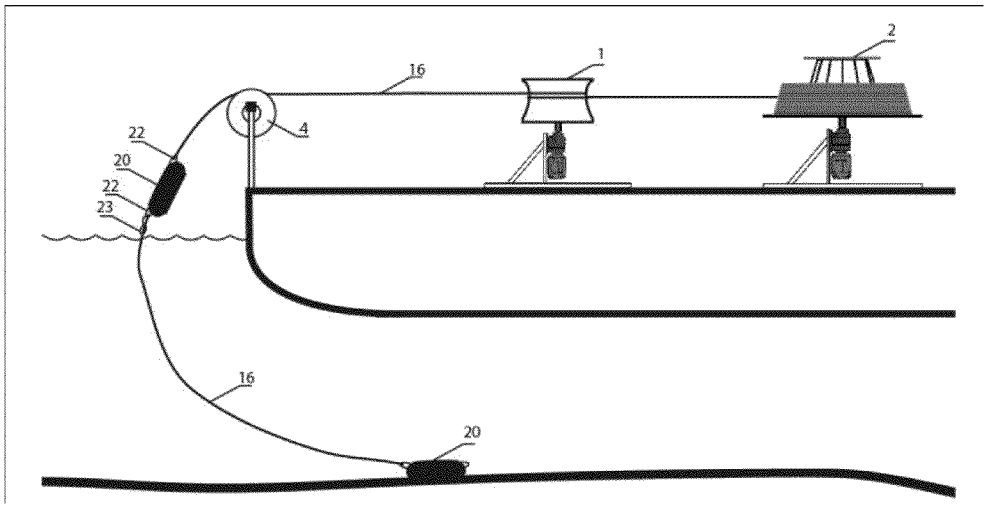
Figure 4B:
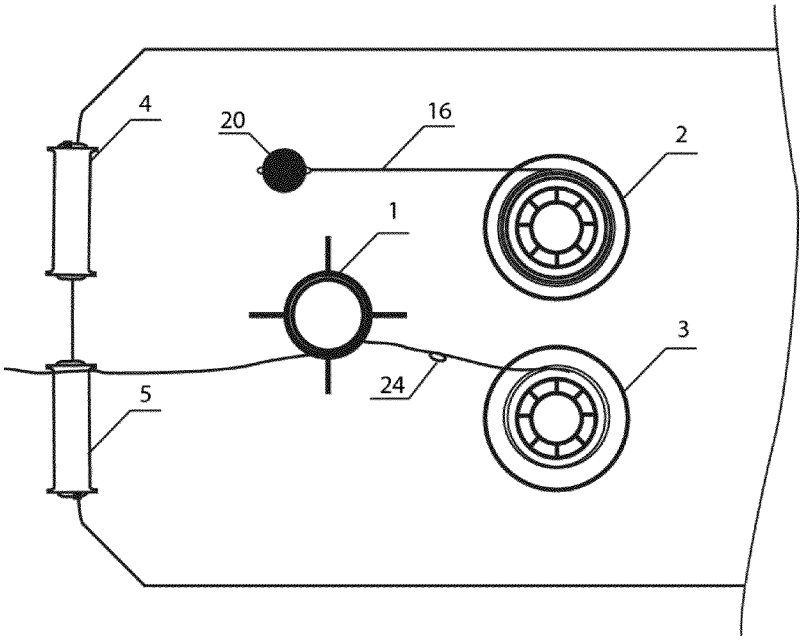

FIGS. 4A and 4B schematically depict a method of recovering of electric-survey BSs and equipment for implementation thereof, according to a preferred embodiment of the present invention.

Figure 5A:
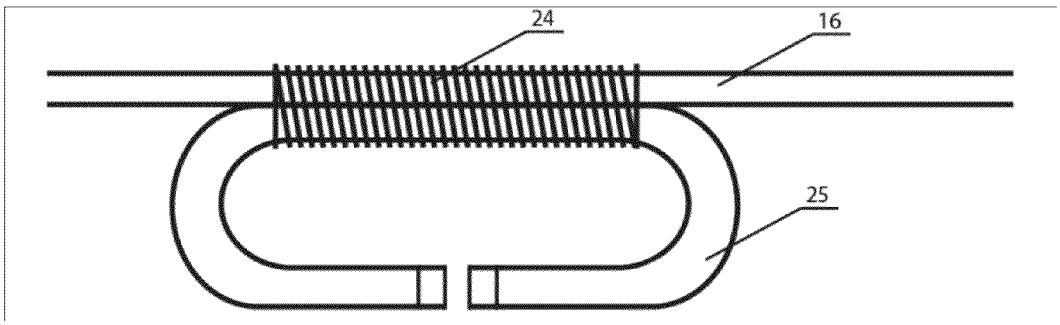
Figure 5B:
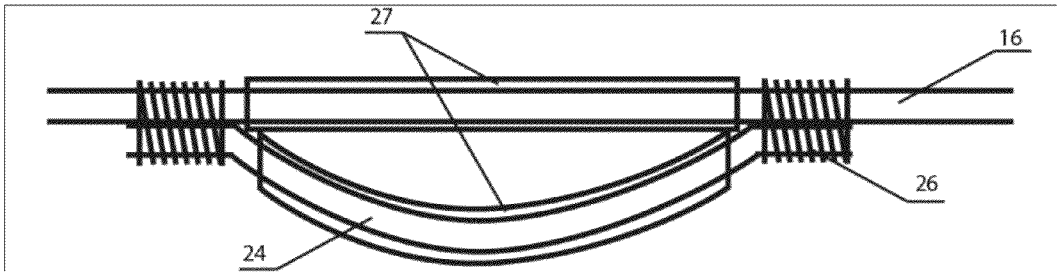
Figure 5C:
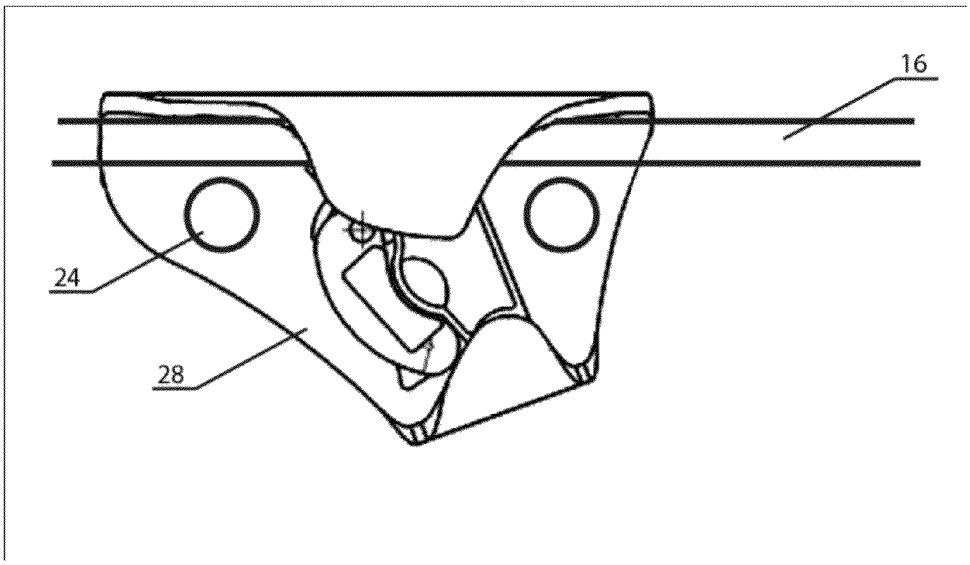

FIGS. 5A, 5B and 5C show design variants of an attachment unit for deployment of BSs, according to a preferred embodiment of the present invention.

Figure 6:
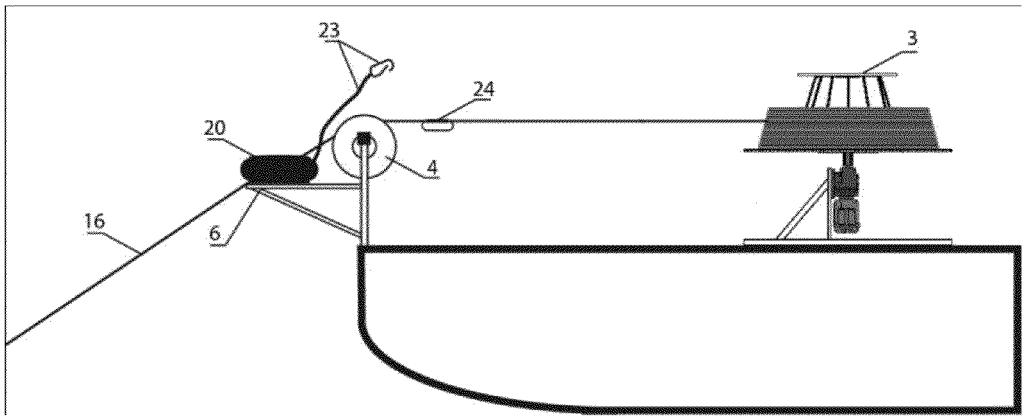

FIG. 6 schematically depicts a method of deployment of seismic BSs and equipment for implementation thereof, according to a preferred embodiment of the present invention.

Figure 7:
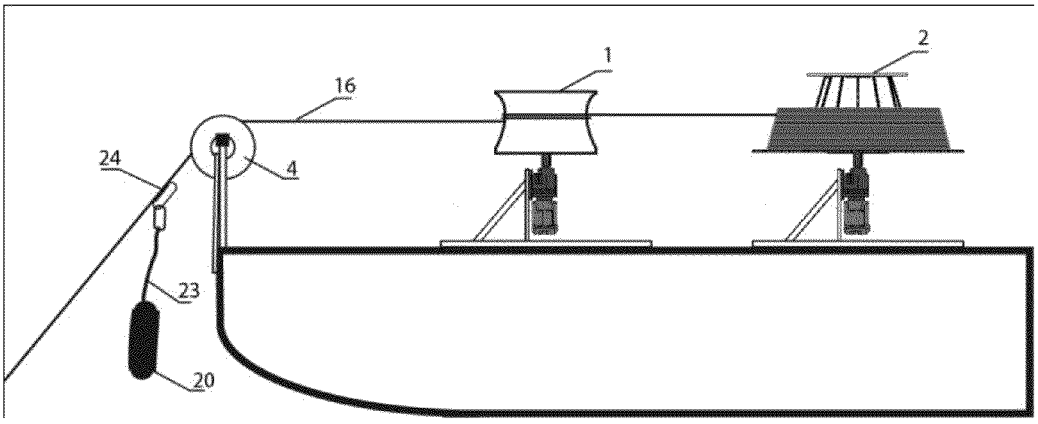

FIG. 7 schematically depicts a method of recovering of seismic BSs and equipment for implementation thereof, according to a preferred embodiment of the present invention.

DETAIL DESCRIPTION OF PREFERRED EMBODIMENTS OF THE INVENTION

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

In the drawings, the following reference numerals are used for denoting respective equipment elements of preferred embodiments of the present invention:

1—a capstan (also called a deploying-recovering device of a 'capstan' type, which generally means a broad revolving cylinder with a vertical axis used for winding a rope or cable, powered by a motor; herein, the capstan is used as a main power means for recovering BSs); 2 and 3—turntables; 4 and 5—rolls (passive revolving cylinder); 6—a work platform (it's capable of supporting a BS placed thereon); 7—a magnetic mark reader; 8—a photo-register (wherein the reader 7 and the photo-register 8 are used for the identification of the BS, and recording its parameters into a database); 9—a limit switch (it is mounted on the work platform 7, and it's switched into an 'on' position when a BS is placed on the work platform, and switched into an 'off' position when a BS is removed from the work platform); 10—a GPS (DGPS) receiver/indicator for determination and registration of coordinates of BSs; 11—a frame; 12—a geared motor-reducer; 13—a base; 14—a conical drum; 15—a removable lid-restrictor; 16—a load-bearing unit; 17—a damping load; 18—a buoy; 19—a damping halyard; 20—a bottom station; 21—a sealed (electrical) connector (used only for electrical survey BSs); 22—a power (mechanical) link of the bottom station; 23—a fastening element of the BS; 24—an attachment unit; 25—a split ring; 26—a loop, or halyard, or rope; 27—a protective tube; and 28—a clamp.

Figure 1:
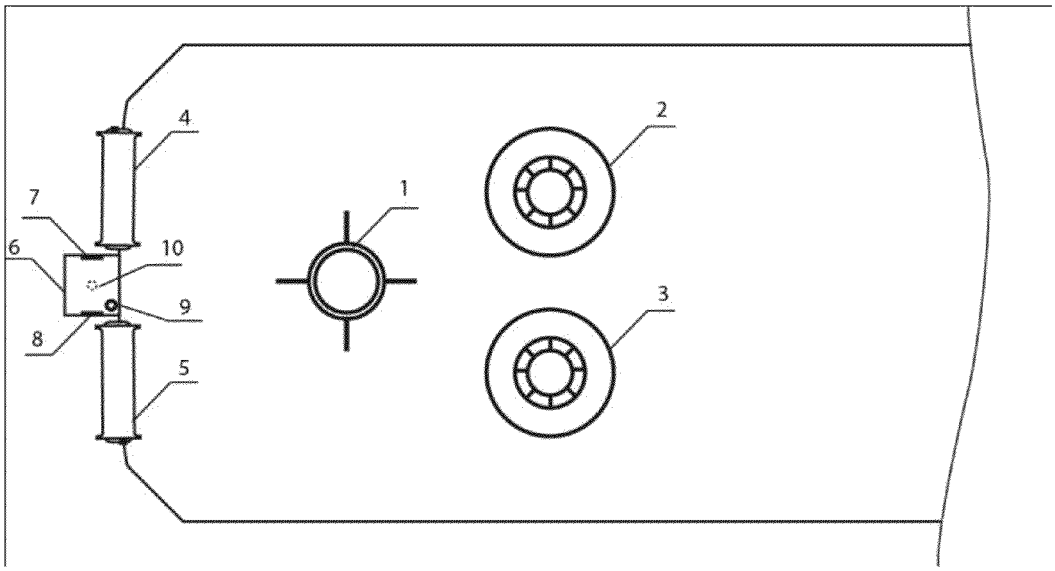
FIG. 1 shows a schematic plan view of the inventive equipment complex depicting the disposition of its elements on a deck of a sea ship.

FIG. 1 shows a possible disposition of the equipment complex's elements on a deck of a non-specialized ship (regular ship), wherein: 1—the capstan; 2 and 3—the turntables; 4 and 5—the rolls; 6—the work platform; 7—the magnetic mark reader; 8—the photo-register; 9—the limit switch; and 10—the GPS (DGPS) receiver.

Depending on the size of the ship's stern, the capstan 1 is located at a distance of 3-5 meters from the roll 4 in a substantially diametrical plane. The turntables 2 and 3 are located symmetrically relative to the capstan 1 at a distance of 2-3 meters from the capstan 1.

Figure 2:
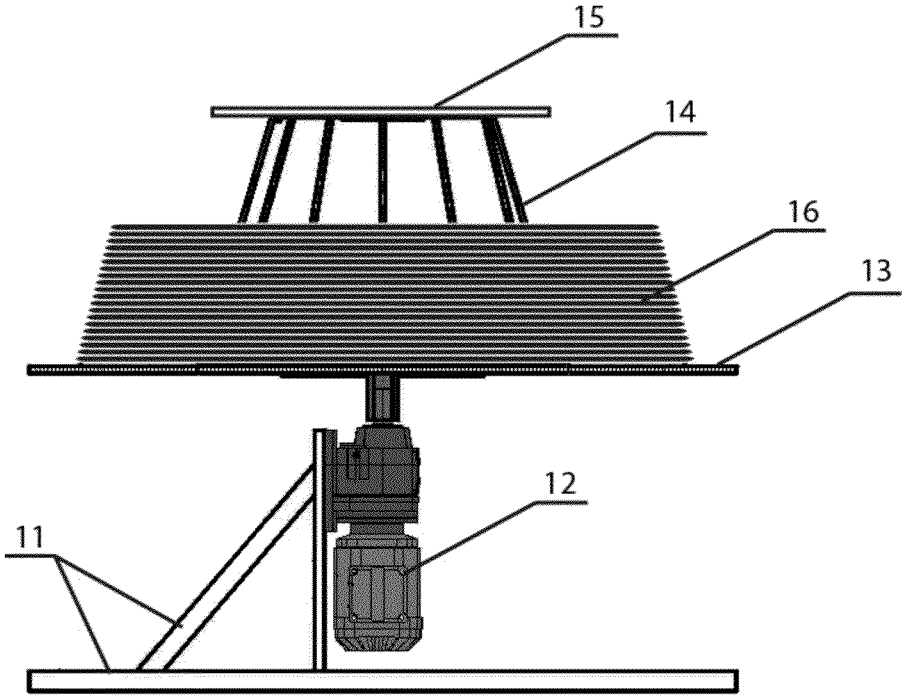
FIG. 2 shows a schematic side view of a turntable, according to a preferred embodiment of the present invention.

According to a preferred embodiment of the present invention, FIG. 2 depicts a design of the turntable 2 or 3, comprising: the frame 11 mounted on the ship's deck; the motor-reducer 12 fixedly mounted on the frame 11, wherein the motor reducer 12 has a rotatable shaft; the base 13 fixedly coupled with the rotatable shaft; the conical drum 14 fixedly mounted on the base 13; and the removable lid-restrictor 15 removably mounted on top of the drum 14. In FIG. 2, the load-bearing unit 16 is shown to be coiled around the drum 14 and rests upon the base 13.

The load-bearing unit 16—(a) may be designed as an electric-conductive receiving line made of a cable with electrodes, if the inventive equipment is used for operating electric-survey BSs; or —(b) may be made of a halyard with negative floatation or of a rope, if the inventive equipment is used for operating seismic BSs. The length of the load-bearing unit 16 may vary in a range from several hundred meters up to 1-2 km, depending on the used ship and the distance between the BSs.

It should be noted that, for the option (a), the process of deploying and recovering electric-survey BSs requires providing not only a mechanical connection, but also an electrical contact of the BS with the load-bearing unit (the receiving line), which is made by using the electrical seal connector 21.

The process of deploying electric-survey BSs by the inventive equipment complex is shown in FIGS. 3A and 3B, wherein: the damping load 17 is connected with the buoy 18 capable of floating on the sea surface; the damping halyard 19 with negative floatation has a slack end connected with the damping load 17 and a bitter end secured on the turntable 2, while the damping halyard 19 is threaded upon (and guided through) the roll 4. The first electric-survey BS 20, supplied with two power links 22, is placed on the platform 6.

The first load-bearing unit 16 (i.e. a 'receiving line', in case of electric-survey BSs) is placed on the turntable 3 (as shown in FIG. 3B). The slack end of the receiving line 16 is threaded upon (and guided through) the roll 5, and connected to the first BS 20 with the help of the sealed connector 21 and the first power link 22. The fastening element 23 is formed with a latch hook or a split ring. A first end of the fastening element 23 is connected with the first power link 22. A second end of the fastening element 23 of first BS 20 is operatively connected with the bitter end of the damping halyard 19.

In this embodiment, the inventive equipment complex operates as follows (FIGS. 3A and 3B). The ship, furnished with the inventive complex, comes at a prescribed point on the survey profile, wherein the first (beginning) damping load 17 with the first (beginning) buoy 18 (of a surface or a self-emerging type) and the first (beginning) damping halyard 19 are thrown out from the ship. The first electric-survey BS 20, under the action of its weight, sets the limit switch 9 into the operative ('ON') position, providing for operation of the photo-register 8 and the magnetic mark reader 7, and causing the identification of the BS and recording its parameters into the database.

In the course of movement of the ship along the survey profile, slipping the first damping halyard 19 occurs, and, when the last 3-4 turns remain on the turntable 2, the lid-restrictor 15 is taken away from the turntable, the remaining turns are taken away from the conical drum 14, and the fastening element 23 of first BS 20 is connected to the bitter end of damping halyard 19.

During a further movement of the ship, the first BS 20 is automatically pulled out from the work platform 6 that ensures reversing the limit switch 9 into the 'OFF' position, and a registration of coordinates of the drop point of the first BS 20 by the GPS receiver 10. The slipping of the first receiving line 16 from the turntable 3 begins, while the next (second) receiving line 16 is placed on the turntable 2.

The next (second) BS 20 is placed on the work platform 6; the second BS 20 is then connected to the bitter end of the first receiving line 16 and to the slack end of the second receiving line 16 (unwinding from the turntable 2), while this slack end is threaded upon (and guided by) the roll 4. The second BS 20 is automatically pulled out from the work platform 6 that ensures reversing the limit switch 9 into the 'OFF' position, and a registration of coordinates of the drop point of the second BS 20 by the GPS receiver 10. The slipping of the second receiving line 16 from the turntable 2 begins, and the next (third) receiving line 16 is placed on the turntable 3. Further, the process is repeated until all the BSs 20 on the survey profile will be installed and deployed. At the end of the profile, the second (ending) buoy 18 with the second (ending) damping load 17 and the second (ending) halyard 19 are installed as shown on FIG. 3.

The process of recovering the BSs (shown in FIGS. 4A and 4B) begins from pulling the damping load 17 and halyard 19 using one of the turntables 2 or 3 via the capstan 1. After pulling up the damping halyard 19 by, for example, the turntable 2, the receiving line 16 is pulled up. At coming of the first BS 20 up to the capstan 1, the fastening element 23 is disconnected from the first receiving line 16; the capstan 1 is released from the first receiving line 16 with the first BS 20; the end of the next (second) receiving line 16 is put on the capstan 1; and a supplemental pulling up by the turntable 3 is then executed. The operation is repeated until recovering all of the BSs 20 on the survey profile.

The proposed equipment complex allows for deployment of other types of geophysical bottom stations. For instance, for deployment of seismic bottom stations without a self-emerging system, the load-bearing unit 16 can be made as a rope or halyard with negative floatation, with the attachment units 24 (for fastening the BSs) arranged on the rope/halyard.

Various design options of the attachment units 24 are depicted on FIGS. 5A-C. The attachment unit 24 may be made in the form of a split ring 25, a loop of halyard or rope 26 protected with an elastic tube 27, or a clump 28 of a "crawl" type moved along the load-bearing unit 16. The distance between the attachment units 24 is defined by a predetermined distance between the BSs installed on the seabed and the sea depth in the survey region. For survey works carried out on sea depths not exceeding 50 meters, the distance between the BSs is approximately the same as the distance between the fastening knots. For works carried out on sea depths more than 50 meters, for ensuring a required distance between the BSs, the distance between the attachment units 24 is non-linearly increased with the depth that can be achieved by the use of the clamps 28.

The process of deployment of seismic BSs on the seabed begins from the installation of the damping load 17 with the buoy 18 and the damping halyard 19, similar to the one described above for electric survey BSs and illustrated on FIG. 3A. The load-bearing unit 16 is placed on the turntable 3; the first BS 20 is placed on the work platform 6 and identified by the photo-register 8 and the mark reader 7.

During the slipping out of the damping halyard 19, its bitter end is connected to the beginning part (front end) of the load-bearing unit 16. At coming of the first attachment unit 24 to the roll 5, the first BS 20, earlier placed on the work platform 6, is connected to the first attachment unit 24 by means of the fastening element 23.

During a further movement, the first BS 20 is automatically pulled out from the work platform 6, that ensures triggering the limit switch 9 and a registration of the drop point coordinates of the first BS 20 by the GPS receiver 10. The next (second) BS 20 is then placed on the work platform 6 and the process repeats till the end of load-bearing unit 16.

During the process of deploying BSs 20, the next load-bearing unit 16 (factually, its front end) is connected to the previous load-bearing unit 16 (factually, to its rear end) at its unwinding; thereafter, the next load-bearing unit 16 is placed on the turntable 2. Such operation ensures a continuity of deployment of the BSs 20 on the profile, and the next load-bearing unit 16 is then placed on the turntable 3. The above-described process is illustrated by FIG. 6.

The inventive technology of deployment of BSs 20 on the seabed utilizes the unwinding of the load-bearing unit 16 that occurs due to the movement of the ship and the action of own weight of BS 20, which ensures deployment of the BSs along the survey profile with an interval approximately equal to the distance between the attachment units 24 on the sea depths not exceeding 50 meters. On greater depths, it's necessary to measure the distance between the attachment units in accordance with changes of the sea depth on the survey profile using the clamp 28.

The claimed equipment complex also allows for deployment of combined seismic-electrical profiles, contemplating the installation of seismic BSs on the survey profile with a step, for example, of 50-100 meters, and the installation of electric-surveying BSs with a step of 500-1000 meters.

For such deployment, the length of the load-bearing units 16 is chosen to provide a step of installation of the electrical-surveying BSs with the receiving lines having such lengths, which do not interfere with a predetermined step of installation of the seismic BSs. At deploying, the receiving line 16, depending on its length, may be located on the ship's deck or on an additional turntable.

During deployment of self-emerging seismic BSs, one of the main difficulties is to provide an accurate (i.e. as exact as possible) installation of the BSs on the survey profile. A free dropping off of the BSs at prescribed points of the profile leads to a great deviation of positioning the BSs on the seabed due to hydrology and hydrodynamic characteristics of the BSs themselves, which diminishes accuracy.

The proposed equipment complex allows for executing a high-accuracy deployment of self-emerging BSs on the seabed for great sea depths in accordance with the above-described technology. In inventive embodiments employed for installation of self-emerging BSs, the load-bearing unit 16, via the attachment units 24, is connected to anchors. The anchors are made of concrete or another heavy material that are placed on the seabed. After receiving a command for self-emerging, the load-bearing unit 16 stays connected to the anchors, and they both are left on the seabed. Since the load-bearing unit 16 remains together with the anchors on the seabed after surveying the profile is finished, the strength requirements to the unit 16 can be significantly lowered, and it may be even made of a fast-corroding or dissoluble material.

The recovering of seismic BSs 20 on board is illustrated on FIG. 7. The seismic BSs 20, being deployed on the seabed, are linked into a chain of units 16, i.e. the load-bearing units 16 are sequentially connected to each other by a link, e.g. the first unit 16 is connected to the second unit 16, etc. Each load-bearing unit 16 is supplied with a number of attachment units 24. Each attachment unit 24 is used for coupling with the fastening element 23 of a corresponding seismic BS 20 similar to the one described above for the electric survey BSs and illustrated on FIG. 3A. A distance between the attachment units 24 depends on the scale of the survey.

The process of recovering the BSs begins from pulling the damping load 17 and halyard 19 using one of the turntables 2 or 3 via the capstan 1 as described above. Then the first load-bearing unit 16 via, for example, the roll 4, is put on the capstan 1, ensuring a force necessary for lifting the BS. During a movement of the ship, the capstan 1, winding the first load-bearing unit 16 on the turntable 2, pulls the first load-bearing unit 16 up; the first BS 20 of the first load-bearing unit 16 is then recovered. After the first BS 20 of the first load-bearing unit 16 passes the roll 4, the fastening element 23 thereof is disconnected from the corresponding attachment unit 24 of the first load-bearing unit 16.

Pulling the first load-bearing unit 16 continues until all the BSs 20 are disconnected from the first load-bearing unit 16, and, when the link between the first unit 16 and the second unit 16 passes the capstan 1, the first unit 16 is disconnected from the second unit 16. The released slack end (unloaded after the capstan 1) of the first load-bearing unit 16 is wound onto the turntable 2.

After pulling up the first load-bearing unit 16 on the turntable 2, this unit 16 is disconnected from the pulled up chain of units 16, and the pulled up chain begins winding onto the turntable 3. The turntable 2 is thus released from the first unit 16 for a subsequent receiving of the next (third) load-bearing unit 16.

During a movement of the ship, the capstan 1, winding the second load-bearing unit 16 on the turntable 3, pulls the second load-bearing unit 16 up; the first BS 20 of the second load-bearing unit 16 is then recovered. After the first BS 20 of the second load-bearing unit 16 passes the roll 4, the fastening element 23 thereof is disconnected from the corresponding attachment unit 24 of the second load-bearing unit 16. Pulling the second load-bearing unit 16 continues until all the BSs 20 are disconnected from the second load-bearing unit 16. The released slack end (unloaded after the capstan 1) of the second unit 16 is wound onto the turntable 3.

Such switching the turntables 2 and 3 allows for participation of both the turntables in the recovering process, which provides for a more efficient recovery of the BSs. The above process is repeated for all load bearing units 16 and BSs 20, until the last BS 20 is recovered.

We claim:

1. An equipment complex for deploying and recovering a number of marine geophysical bottom stations; said equipment complex is mounted on a ship; said equipment complex comprising:

a capstan;

at least two rotatable turntables;

at least two rotatable rolls;

a number of load-bearing units capable of winding and unwinding on the capstan and on the turntables, and capable of being guided by the rolls;

at least one work platform capable of supporting one of said bottom stations placed thereon;

an indicator for determination and registration of coordinates of said bottom stations, said indicator is mounted on said work platform; and a limit switch mounted on said work platform, wherein said limit switch has an ON position when the bottom station is placed on the work platform, and an OFF position when the bottom station is removed from the work platform.

2. The equipment complex according to claim 1, further comprising a photo-register mounted on the work platform; said photo-register is capable of identification of the bottom stations, and recording parameters thereof into a database.

3. The equipment complex according to claim 1, further comprising a reader of magnetic marks mounted on the work platform; said reader of magnetic marks is capable of identification of the bottom stations, and recording parameters thereof into a database.

4. The equipment complex according to claim 1, wherein said geophysical bottom stations are electrical survey bottom stations; and the load-bearing units each is made of an electric-conductive cable in the form of a receiving line with electrodes.

5. The equipment complex according to claim 1, further comprising a number of attachment units coupled with each of said load-bearing units, and each said attachment unit is coupled with one said bottom station; and wherein the load-bearing units each is made of a rope or halyard with negative floatation.

6. The equipment complex according to claim 5, wherein said attachment units each is made in one of the following forms: a split ring; or a loop made of a rope or a halyard, said loop is covered by a protective elastic tube; or a clamp of a crawl type.

7. The equipment complex according to claim 1, wherein: said geophysical bottom stations are self-emerging bottom stations; the load-bearing units each is coupled to a number of anchors; and the load-bearing units each is made of fast-corroding or fast-dissoluble material.

8. A method of deploying the equipment complex according to claim 4 on a survey profile, wherein:

said at least two rotatable turntables are a first turntable and a second turntable;

said at least two rotatable rolls are a first roll and a second roll;

said at least one work platform is a work platform;

said number of marine geophysical bottom stations include at least:

a first bottom station, a second bottom station, and a third bottom station;

said number of load-bearing units include at least:

a first load-bearing unit having a slack end and a bitter end, a second load-bearing unit having a slack end and a bitter end, a third load-bearing unit having a slack end and a bitter end;

said equipment complex further comprising:

a first buoy and a second buoy both capable of floating on a sea surface;

a first damping load connected with the first buoy, and a second damping load connected with the second buoy;

a first halyard with negative floatation having a slack end and a bitter end; and a second halyard with negative floatation having a slack end and a bitter end;

said method including the steps of:

a) connecting said slack end of the first halyard with the first damping load, and securing said bitter end of the first halyard on the first turntable;

b) threading the first halyard upon the first roll;

c) placing the first load-bearing unit in a coiled form on the second turntable;

d) threading said slack end of the first load-bearing unit upon the second roll; connecting said slack end of the first load-bearing unit essentially with the first bottom station;

e) in a predetermined place of the survey profile, throwing the first damping load with the first buoy from the ship;

f) placing the first bottom station on said work platform, setting said limit switch into the ON position, thereby providing for operation of said indicator;

g) during a movement of the ship, slipping the first halyard out thereby causing a pull out of the first bottom station from said work platform and dropping the first bottom station in a drop point of said survey profile, thereby reversing said limit switch into the OFF position, which provides for registration of coordinates of said drop point of the first bottom station;

h) unwinding and slipping the first load-bearing unit out from the second turntable;

i) placing the second load-bearing unit in a coiled form on the first turntable;

j) placing the second bottom station on said work platform, setting said limit switch into the ON position, thereby providing for operation of said indicator;

k) connecting the second bottom station essentially to said bitter end of the first load-bearing unit and to said slack end of the second load-bearing unit unwinding from the first turntable, while threading said slack end of the second load-bearing unit upon the first roll;

l) slipping the first load-bearing unit out from the second turntable thereby causing a pull out of the second bottom station from said work platform and dropping the second bottom station in a drop point of said survey profile, thereby reversing said limit switch into the OFF position, which provides for registration of coordinates of said drop point of the second bottom station;

m) unwinding and slipping the second load-bearing unit out from the first turntable;

n) placing the third load-bearing unit in a coiled form on the second turntable;

o) placing the third bottom station on said work platform, setting said limit switch into the ON position, thereby providing for operation of said indicator;

p) connecting the third bottom station essentially to said bitter end of the second load-bearing unit and to said slack end of the third load-bearing unit unwinding from the second turntable, while threading said slack end of the third load-bearing unit upon the second roll;

q) slipping the second load-bearing unit out from the first turntable thereby causing a pull out of the third bottom station from said work platform and dropping the third bottom station in a drop point of said survey profile, thereby reversing said limit switch into the OFF position, which provides for registration of coordinates of said drop point of the third bottom station; and r) if said number of marine geophysical bottom stations are greater than three, and said number of load-bearing units are greater than three, then repeating the steps (m), (n), (o), (p) and (q) for respective bottom station numbers and load-bearing unit numbers, and taking turns for the first turntable and the second turntable, as well as for the first roll and the second roll, until a last bottom station is dropped off on the survey profile;

s) securing said bitter end of the second halyard on the corresponding turntable; connecting said slack end of the second halyard essentially with the last bottom station, and connecting the second damping load to said bitter end of the second halyard;

t) threading the second halyard upon the corresponding roll; and u) throwing the second damping load with the second buoy thereby securing the marine geophysical bottom stations on the survey profile.

9. A method of recovering the equipment complex according to claim 4 on a survey profile, wherein:

said at least two rotatable turntables are a first turntable and a second turntable;

said number of marine geophysical bottom stations are arranged as a chain of bottom stations connected with each of the corresponding said number of load-bearing units and installed on a seabed of the survey profile;

said number of marine geophysical bottom stations include at least: a first bottom station, a second bottom station, and a last bottom station being last in said chain;

said number of load-bearing units include at least a first load-bearing unit, a second load-bearing unit, and a last load-bearing unit being last in said chain;

said equipment complex further comprising:

a buoy capable of floating on a sea surface; a damping load connected with the buoy;

and a halyard with negative floatation connecting said buoy and said damping load;

wherein said chain of bottom stations includes said damping load connected to the first bottom station by the first load-bearing unit; the first bottom station is connected to the second bottom station by the second load-bearing unit, and the last bottom station is connected with the last load-bearing unit;

said method including the steps of:

a) pulling the halyard and the damping load by winding the halyard connected to the buoy onto the capstan, and further onto the first turntable; at coming the damping load up to the capstan, disconnecting the damping load from the halyard; releasing the capstan from the halyard;

b) pulling the first load-bearing unit with the first bottom station by winding the first load-bearing unit onto the capstan and then onto the second turntable; at coming the first bottom station up to the capstan, disconnecting the first bottom station from the first load-bearing unit; releasing the capstan from the first load-bearing unit;

c) pulling the second load-bearing unit with the second bottom station by winding the second load-bearing unit onto the capstan and then onto the first turntable; at coming the second bottom station up to the capstan, disconnecting the second bottom station from the second load-bearing unit; releasing the capstan from the second load-bearing unit;

d) repeating the steps (a), (b) and (c) for respective said bottom station numbers and said load-bearing unit numbers, and taking turns for the first turntable and the second turntable, until the last bottom station is recovered from the seabed.

10. A method of deploying the equipment complex according to claim 2 on a survey profile, wherein:

said at least two rotatable turntables are a first turntable and a second turntable;

said at least two rotatable rolls are a first roll and a second roll;

said at least one work platform is a work platform;

said number of marine geophysical bottom stations is a number of seismic bottom station each supplied with a fastening element; said number of seismic bottom stations include at least a first bottom station and a second bottom station;

said number of load-bearing units are at least a first load-bearing unit and a second load-bearing unit; said load bearing units each has a front end and a back end, and is supplied with a number of attachment units distributed along thereof and connectable with said fastening elements;

said equipment complex further comprising:

a buoy capable of floating on a sea surface;

a damping load connected with the buoy;

a halyard with negative floatation; said halyard having a slack end connected with the damping load, and a bitter end; and a reader of magnetic marks mounted on the work platform; said reader of magnetic marks is capable of identification of the bottom stations, and recording parameters thereof into a database;

said method including the steps of:

a) threading the halyard upon the first roll and placing the halyard on the first turntable;

b) in a predetermined place of the survey profile, throwing the damping load with the buoy;

c) placing the first load-bearing unit in a coiled form on the second turntable;

d) placing the first bottom station on said work platform, setting said limit switch into the ON position, thereby providing for operation of said indicator; identifying the first bottom station by the photo-register and the reader of magnetic marks;

e) slipping the halyard out, connecting said bitter end of the halyard to said front end of the first load-bearing unit;

f) upon coming a first said attachment unit of the first load-bearing unit to the second roll, connecting the first attachment unit to the fastening element of the first bottom station;

g) further slipping the halyard out causing a pull out of the first bottom station from said work platform and dropping the first bottom station in a drop point of said survey profile, thereby reversing said limit switch into the OFF position, which provides for registration of coordinates of said drop point of the first bottom station;

h) placing the second bottom station on said work platform, setting said limit switch into the ON position, thereby providing for operation of said indicator; identifying the second bottom station by the photo-register and the reader of magnetic marks;

i) upon coming a second said attachment unit of the first load-bearing unit to the second roll, connecting the second attachment unit to the fastening element of the second bottom station;

j) slipping the first load-bearing unit out from the second turntable thereby causing a pull out of the second bottom station from said work platform and dropping the second bottom station in a drop point of said survey profile, thereby reversing said limit switch into the OFF position, which provides for registration of coordinates of said drop point of the second bottom station; and k) placing the second load-bearing unit in a coiled form on the first turntable, connecting said front end of the second load-bearing unit to said back end of the first load-bearing unit; and l) repeating the steps (f)-(k) for all said load-bearing units and all said bottom stations, while switching the first and second turntables for placing each next said load-bearing unit.

11. A method of recovering the equipment complex according to claim 1 on a survey profile, wherein:

said at least two rotatable turntables are a first turntable and a second turntable;

said at least two rotatable rolls are a first roll and a second roll;

said at least one work platform is a work platform;

said number of marine geophysical bottom stations are a number of seismic bottom stations connected to the corresponding said number of load-bearing units and installed on a seabed of the survey profile;

said number of load-bearing units are connected to each other in a chain characterized in that any pair of said load-bearing units is coupled by a link; said number of load-bearing units include at least a first load-bearing unit, a second load-bearing unit, and a third load-bearing unit;

said method including the steps of:

a) threading the first load-bearing unit upon the first roll and coiling thereof on the capstan;

b) during a movement of the ship, pulling the first load-bearing unit by winding thereof up onto the capstan; after the first bottom station of said first load-bearing unit passes the first roll, disconnecting the first bottom station from the first load-bearing unit;

c) repeating the step (b) for all said bottom stations connected to the first load-bearing unit;

d) when said link between the first load-bearing unit and the second load-bearing unit passes the capstan, disconnecting the first load-bearing unit from said chain;

e) releasing the capstan from the first load-bearing unit and further winding the first load-bearing unit onto the first turntable;

f) during a movement of the ship, pulling the second load-bearing unit with said bottom stations, connected thereto, by the capstan;

g) conducting the steps (b), (c), and (d) for the second load-bearing unit;

h) releasing the capstan from the second load-bearing unit, and further winding the second load-bearing unit onto the second turntable;

i) during a movement of the ship, pulling the third load-bearing unit with said bottom stations, connected thereto, by the capstan;

j) conducting the steps (b), (c), and (d) for the third load-bearing unit;

k) releasing the capstan from the third load-bearing unit, and further winding the third load-bearing unit onto the first turntable; and l) repeating the steps (b) through (k) for respective said bottom stations and said load-bearing units, while taking turns for the first turntable and the second turntable, until all said number of bottom stations are recovered from the seabed.

* * * * *